United States Patent [19]

Wochnowski et al.

[11] 3,948,277

[45] Apr. 6, 1976

[54] METHOD AND APPARATUS FOR CHANGING THE MOISTURE CONTENT OF TOBACCO

[75] Inventors: Waldemar Wochnowski, Hamburg-Meiendorf; Hans Förster, Hamburg; Jürgen Koehn, Wentorf; Reinhard Hohm, Pinneberg, all of Germany

[73] Assignee: Hauni-Werke Korber & Co. KG, Hamburg-Bergedorf, Germany

[22] Filed: Aug. 17, 1973

[21] Appl. No.: 389,353

[30] Foreign Application Priority Data

Aug. 18, 1972 Germany ..... 2240682

[52] U.S. Cl. ..... 131/135; 34/45; 34/46

[51] Int. Cl.² ..... A24C 3/04; A24C 9/00

[58] Field of Search ..... 131/135, 140 R, 133 R, 131/134, 137, 138, 21 R; 34/45, 46; 432/107

[56] References Cited

UNITED STATES PATENTS

| | | | |
|---|---|---|---|
| 2,768,629 | 10/1956 | Maul | 34/46 X |
| 3,357,436 | 12/1967 | Wright | 34/46 X |
| 3,372,488 | 3/1968 | Koch et al. | 131/135 X |
| 3,409,025 | 11/1968 | Wochnowski | 131/135 |
| 3,494,367 | 2/1970 | Maguire | 131/135 |
| 3,556,111 | 1/1971 | Wochnowski | 131/135 |
| 3,760,816 | 9/1973 | Wochnowski | 131/140 R |
| 3,785,765 | 1/1974 | Rowell et al. | 432/107 |
| 3,794,049 | 2/1974 | Wochnowski | 131/135 |
| 3,799,176 | 3/1974 | Wochnowski | 131/135 |

*Primary Examiner*—Louis G. Mancene
*Assistant Examiner*—John F. Pitrelli
*Attorney, Agent, or Firm*—Kane, Dalsimer, Kane, Sullivan and Kurucz

[57] ABSTRACT

The moisture content of a stream of tobacco leaves is increased during travel through a rotary drum wherein the leaves are contacted by and exchange heat and moisture with a current of hot humid air which flows concurrent with the leaves. The moisture content of air is regulated in dependency on deviations of the final moisture content of tobacco leaves from a desired final moisture content by varying the temperature of a shower of water droplets across which the air current passes on its way into the inlet end of the drum. The temperature of air is normally constant but is changed when the initial moisture content of tobacco leaves exceeds the desired final moisture content. Tobacco leaves entering the inlet end of the drum are subjected to a preliminary moisturizing action of steam and/or atomized water, and such moisturizing action can be varied in dependency on fluctuations of initial and/or final moisture content of tobacco and/or in dependency on fluctuations in the rate of tobacco delivery into the drum. The preliminary moisturizing action requires no adjustment if the steam of tobacco leaves is equalized upstream of the drum.

35 Claims, 3 Drawing Figures

METHOD AND APPARATUS FOR CHANGING THE MOISTURE CONTENT OF TOBACCO

BACKGROUND OF THE INVENTION

The present invention relates to a method and apparatus for changing the moisture content of fibrous material, especially tobacco, and more particularly to a method and apparatus for changing the moisture content of fibrous material (hereinafter referred to as tobacco) by contacting tobacco with a gaseous fluid whose moisture content is normally different from that of tobacco. As a rule, the gaseous fluid is air which is conveyed in the form of one or more currents preferably flowing concurrent with the particles of a tobacco stream.

The treatment of tobacco leaves prior to conversion into fillers of cigarettes, cigarillos or cigars or into chewing tobacco involves a number of processes. The moisture content of tobacco leaves which are shipped by growers too processing plants is very low. Therefore, the resistance of such leaves to mechanical stresses is negligible, i.e., the leaves tend to break into smaller or larger fragments which is highly undesirable for a number of reasons. Consequently, the first stage of treatment of tobacco in a plant normally involves raising the moisture content well above the initial moisture content so as to insure that the next-following treatments, such as destalking of tobacco leaves, can be carried out without pronounced breakage. The moisture content of tobacco leaves prior to destalking, shredding and similar treatments must be maintained within a very narrow range, especially in modern tobacco processing plants where the treatment is fully automatic and the machinery for the processing of tobacco is supervised by a small number of semiskilled or even unskilled attendants.

German Auslegeschrift No. 1,145,530 discloses an apparatus for increasing the moisture content of tobacco wherein a stream of tobacco particles (e.g., leaves) is conveyed through a rotating drum and is contacted by a current of moist air which is caused to flow concurrent with the tobacco stream. There is no provision to regulate the temperature and/or moisture content of air so as to insure that the final moisture content of tobacco will not deviate from a predetermined optimum value or from a narrow range of optimum values.

U.S. Pat. No. 3,556,111 discloses a conditioning apparatus for Burley Tobacco. Such tobacco is heated to an elevated temperature in order to expel therefrom nitrogen gas which exerts an adverse influence on the taste and aroma of tobacco. The heating action is so pronounced that the moisture content of tobacco is automatically reduced to a very low value. Therefore, the tobacco must be caused to pass through a conditioning apparatus wherein its moisture content is raised by contact with currents of moist air which pass through a foraminous conveyor for a stream of tobacco particles. The air is moisturized by atomized liquid (normally water) and the rate of moisturization of air is regulated as a function of changes in the final moisture content of tobacco. Such regulation does not insure that the final moisture content of tobacco does not deviate appreciably from an optimum value. Moreover, the droplets of liquid which are carried by the currents of air are likely to be absorbed by tobacco particles which are first to come in contact therewith; this results in non-uniform wetting of tobacco.

SUMMARY OF THE INVENTION

An object of the invention is to provide a novel and improved method of changing the moisture content of tobacco or analogous fibrous material so that the ultimate moisture content coincides with or deviates negligibly (within permissible limits) from a desired final moisture content which is best suited for further processing of fibrous material, e.g., for destalking of tobacco leaves.

Another object of the invention is to provide a method of changing the moisture content of tobacco or analogous fibrous materials in such a way that the final moisture content of each portion or stratum of fibrous material equals or closely approximates a desired moisture content.

A further object of the invention is to provide a novel multi-stage method of increasing the moisture content of tobacco.

An additional object of the invention is to provide a novel and improved method of conditioning gaseous and/or liquid media which are utilized to change the moisture content of tobacco or the like.

Still another object of the invention is to provide a novel and improved apparatus for changing (increasing or reducing) the moisture content of tobacco or the like which is more versatile and more accurate than heretofore known apparatus and which can change the moisture content of fibrous material to a desirable optimum value irrespective of whether the material is being fed at a constant rate or at a rate which fluctuates at random within a wide or narrow range.

A further object of the invention is to provide a tobacco conditioning apparatus which is convertible from a mode of operation to increase the moisture content to a mode of operation to reduce the moisture content, or vice versa, in automatic response to detection of the initial moisture content of tobacco.

Another object of the invention is to provide the conditioning apparatus with novel and improved means for automatically regulating the characteristics of one or more gaseous or liquid fluids which are used to change the moisture content of tobacco.

One feature of the present invention resides in the provision of a method of changing (increasing or reducing) the moisture content of tobacco or analogous fibrous material which comprises the steps of conveying a stream of fibrous material along a predetermined path, subjecting successive increments of fibrous material in a predetermined portion of the path to a moisturizing action (e.g., with sprays of a liquid moisturizing agent and/or steam) so that the moisture content of fibrous material increases, contacting the moisturized fibrous material with at least one current of air or another suitable gaseous fluid whose moisture content normally deviates from the increased moisture content of fibrous material whereby the fibrous material exchanges moisture with the fluid, and automatically changing the moisture content of gaseous fluid when the moisture content of fibrous material subsequent to the contacting step deviates from a predetermined moisture content, i.e., from the desired final moisture content of fibrous material. The moisturizing step preferably immediately precedes the contacting step.

The path for fibrous material preferably includes an elongated conditioning zone and the gaseous fluid is preferably circulated or conveyed along an endless second path a portion of which coincides with or includes the conditioning zone and wherein the gaseous fluid flows concurrent with fibrous material. The step of changing the moisture content of gaseous fluid preferably includes measuring the moisture content of fibrous material which issues from the conditioning zone, comparing the measured moisture content with the desired final moisture content, and automatically changing the moisture content of gaseous fluid when the measured moisture content of fibrous material deviates from the desired final moisture content.

The step of changing the moisture content of gaseous fluid in response to detected deviations of measured moisture content of fibrous material from the desired final moisture content may comprise conveying the current of gaseous fluid across a spray of a preferably finely atomized liquid moistening agent (e.g., water), and changing the temperature of the spray as a function of deviations of the measured moisture content of fibrous material from the desired final moisture content.

The method preferably further comprises the step of normally maintaining the temperature of gaseous fluid which is admitted into the conditioning zone at a constant value (e.g., 100° C), and the path for circulation of gaseous fluid is normally sealed or practically sealed from the surrounding atmosphere. If the method comprises the aforementioned moisturizing step, the addition of moisture to fibrous material on entry of fibrous material into the conditioning zone can take place independently of the exchange of heat between fibrous material and gaseous fluid, i.e., the rate of such independent addition of moisture can be selected in advance and thereupon remains unchanged, or the rate of independent addition of moisture can be regulated as a function of at least one variable other than that which controls the regulation of moisture content of gaseous fluid. For example, the method may further comprise the steps of measuring the moisture content of fibrous material ahead of the conditioning zone and reducing or increasing the quantity of added moisture when the measured moisture content of fibrous material ahead of the conditioning zone respectively exceeds or is less than a predetermined or anticipated initial moisture content.

Furthermore, the method may comprise the step of conveying fibrous material along the predetermined path in the form of a continuous stream, measuring the quantity of fibrous material in the stream ahead of the conitioning zone, and reducing or increasing the quantity of added moisture when the measured quantity of fibrous material respectively decreases or increases or when the measured quantity of fibrous material is less than or exceeds a predetermined average quantity.

The fibrous material can be admitted into the predetermined path in the form of an unequalized stream (i.e., with varying quantities of material in successive increments of the stream), and the method may comprise the additional step of equalizing the stream ahead of the conditioning zone. The equalizing step may comprise accumulating a supply of fibrous material in a magazine upstream of the conditioning zone, maintaining the quantity of fibrous material in the supply within a predetermined narrow range, and withdrawing from the magazine fibrous material at a constant or nearly constant rate for introduction into the conditioning zone.

The method preferably comprises the step of heating and moisturizing the gaseous fluid prior to entry into the conditioning zone, and the optional (but highly advantageous) steps of measuring the moisture content of fibrous material ahead of the conditioning zone and interrupting the moisturizing step when the measured moisture content of fibrous material ahead of the conditioning zone exceeds a predetermined moisture content (e.g., the desired final moisture content) so that the gaseous fluid then merely heats and thus reduces the moisture content of fibrous material in the conditioning zone. The temperature of gaseous fluid may be varied prior to entry of fluid into the conditioning zone so that the fluid temperature increases when the measured moisture content of fibrous material ahead of the conditioning zone exceeds the aforementioned predetermined value.

If the fibrous material is conveyed in the form of a stream wherein the quantity of material fluctuates, the method may comprise the additional steps of measuring the quantity of fibrous material in the stream ahead of the conditioning zone and varying the temperature of gaseous fluid prior to entry into the conditioning zone so that the fluid temperature respectively rises and drops when the quantity of fibrous material respectively increases or decreases while the moisture content of fibrous material ahead of the conditioning zone exceeds the aforementioned predetermined value.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
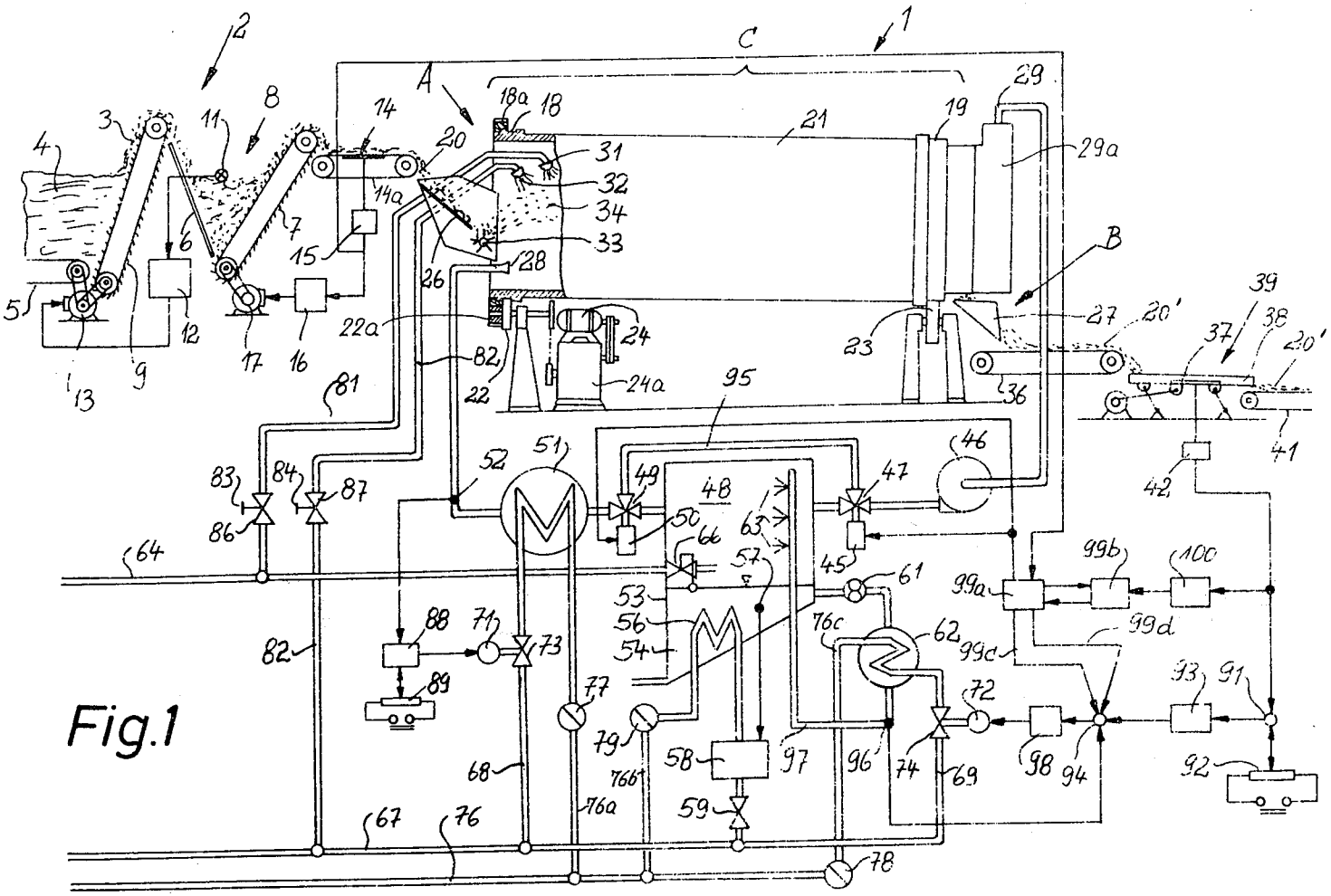
FIG. 1 is a diagrammatic partly elevational and partly sectional view of a first apparatus for conditioning tobacco or similar fibrous material wherein the preliminary wetting of fibrous material can be regulated by hand.

FIG. 1 illustrates an apparatus for changing the moisture content of tobacco leaves which are supplied in the form of bales 4. The apparatus is designed to increase the moisture content of tobacco leaves and comprises a tobacco conditioning unit 1 which receives a stream 20 of tobacco leaves from a tobacco feeding and metering unit 2. A bale 4 containing a mass of compacted tobacco leaves rests on the upper stretch of an endless band conveyor 5 which urges the righthand or front side of the bale against the upwardly moving stretch of a carded conveyor 9 so that the latter removes from the bale an unequalized stream 3 of tobacco leaves which are fed into a magazine or hopper 8 of the unit 2. One side of the magazine 8 is formed by a stationary wall 6 and the other side by the upwardly moving stretch of a carded conveyor 7. The supply of tobacco leaves in the magazine 8 is monitored by photoelectric detector means 11 which transmits signals to a control circuit 12 serving to regulate the speed of a variable-speed prime mover 13 (e.g., an electric motor) which drives the conveyors 5 and 9. For example, the detector means 11 may comprise an upper lever detector which causes the control circuit 12 to decelerate the motor 13 (and to thus reduce the rate of delivery of tobacco leaves into the magazine 8) when the supply of tobacco leaves in the magazine rises to a maximum permissible level, and a lower level detector which causes the control circuit 12 to accelerate the motor 13 when the supply of tobacco leaves reaches a predetermined minimum level. This insures that the level of tobacco leaves in the magazine 8 remains constant or fluctuates within a narrow range which is desirable because the carded conveyor 7 is more likely to withdraw from the magazine a constant stream of tobacco leaves if the quantity of leaves in the magazine changes little or not at all. The details of the control circuit 12 form no part of the present invention; such circuits are available in a variety of forms.

The stream of tobacco leaves which is withdrawn from the magazine 8 by the upwardly moving stretch of the carded conveyor 7 descends onto the upper stretch of an endless conveyor belt 14*a* forming part of a weighing device or detector 14 whose function is to insure that the conditioning unit 1 receives an "equalized" stream 20 of tobacco leaves, i.e., a stream wherein each increment contains the same quantity of tobacco leaves. A transducer 15 of the weighing device 14 generates electric signals whose intensity is proportional to the weight of tobacco leaves on the upper stretch of the conveyor belt 14*a*, and such signals are transmitted to a control circuit 16 which regulates the speed of a variable-speed prime mover 17 (e.g., an electric motor) for the carded conveyor 7. The control circuit 16 compares the intensity of signals furnished by the transducer 15 with a predetermined intensity which is indicative of the desired rate of tobacco feed into the conditioning unit 1 and accelerates or decelerates the motor 17 when the detected rate of tobacco feed is respectively below or exceeds the desired rate.

The just described tobacco feeding and metering unit is capable of supplying tobacco leaves at a rate which deviates negligibly from or matches a desired optimum rate. A somewhat similar feeding and metering unit for tobacco is disclosed in German Offenlegungsschrift No. 1,914,466.

The conditioning unit 1 comprises a slightly inclined hollow rotary drum 21 which constitutes a conveyor for the stream of tobacco leaves and has spaced-apart flanges 18, 19 resting on supporting rollers 22, 23. The drive means for rotating the drum 21 comprises an electric motor 24 and a variable-speed transmission 24*a* which drives a pinion 22*a* mating with a ring gear 18*a* on the drum 21. The pinion 22*a* is but need not be coaxial with one of the supporting rollers 22.

The inlet end A of the drum 21 receives tobacco leaves from the endless conveyor belt 14*a* through the intermediary of a chute 26 whose lower end supplies tobacco leaves into the range of paddles, blades, teeth or analogous projections on a rapidly rotating winnower roller 33. A second chute 27 is provided at the discharge end B of the drum 21 to guide conditioned tobacco leaves onto the upper stretch of an endless transfer conveyor 36.

The inlet end A of the drum 21 further receives the outlet of a conduit 28 for admission of heated and moistured air which flows concurrent with tobacco leaves in the drum 21 and is withdrawn from a hood 29*a* at the discharge end B. The hood 29*a* is connected with the intake end of an evacuating conduit 29. Nozzles 31 and 32 which extend into the inlet end A of the drum 21 respectively serve to admit additional moisture in the form of water and steam. Such additional moisture is sprayed onto a shower 34 of tobacco leaves which is formed by the winnower roller 33. The drum 21 defines a conditioning zone C wherein the air which is admitted by the conduit 28 exchanges heat and moisture with tobacco leaves which travel from the inlet end A toward the discharge end B.

The aforementioned transfer conveyor 36 delivers successive increments of a stream 20' of conditioned tobacco leaves into the vibrating trough 38 of a moisture measuring device or detector 39. The latter further comprises one or more capacitors 37 which are connected with a transducer 42 serving to generate electric signals whose intensity is proportional to the final moisture content of tobacco leaves in the vibrating trough 38. A detector similar to the moisture measuring device 39 of FIG. 1 is disclosed in U.S. Pat. No. 3,429,311. The device 39 is of the type known as HWK III produced and sold by the West German Firm Hauni-Werke, Körber & Co. K.G., of Hamburg-Bergedorf.

A take-off conveyor 41 receives conditioned tobacco leaves from the trough 38 for transport to the next processing station, for example, into a destalking machine wherein the stem and ribs of the leaves are separated from tobacco leaf laminae.

The transducer 42 of the moisture measuring device 39 is preferably of the type disclosed in the aforementioned U.S. Pat. No. 3,429,311.

The evacuating conduit 29 for spent conditioning air is connected with the suction side of a fan 46 which can cause such air to flow back into the conduit 28 by way of a first valve 47, an air conditioning unit 48, a second valve 49 and a heating device here shown as a heat exchanger 51. The valves 47 and 49 are three-way valves and are respectively controlled by electromagnets 45, 50. It will be seen that the current of air which exchanges heat and moisture with tobacco leaves in the zone C is caused to circulate along a substantially closed endless path and is kept in motion by the fan 46, moisturized in the unit 48, and heated in the heat exchanger 51. The endless path for the current of air is defined by conduit 28, drum 21, hood 29*a*, conduit 29, fan 46, valve 47, air conditioning unit 48, valve 49 and heat exchanger 51. It will be noted that a portion (in 21) of the endless path for the air current coincides with a portion (zone C) of the path which is defined for tobacco leaves by the conveyor means 5, 9, 7, 14*a*, 26, 21, 27, 36, 38 and 41.

A temperature detector 52 is installed in the conduit 28 close to the outlet of the heat exchanger 51 to furnish electric signals which are indicative of the temperature of air flowing into the drum 21.

The air conditioning unit 48 comprises a sealed container or vessel 53 the lower portion of which contains a supply or body 54 of liquid (e.g., water). The liquid in the vessel 53 is heated by a heat exchanger 56 which includes a coil for circulation of steam, and the temperature of such liquid is measured by a detector 57 serving to transmit electric signals to a regulator 58 (e.g., and adjustable valve) which changes the rate of steam circulation in the coil of the heat exchanger 56 when the temperature of liquid in the vessel 53 deviates from a desired or preselected temperature. A pressure reducing valve 59 is connected between the inlet of the regulator 58 and a tube 67 which supplies steam to the apparatus.

A pump 61 draws liquid from the vessel 53 and supplies the thus withdrawn liquid into a steam-heated heat exchanger 62. The heated liquid is conveyed into the upper portion of the vessel 53 by a pipe 97 and is discharged into the air flowing from the valve 47 toward the valve 49 by way of one or more spray nozzles 63. The pump 61 causes a pressurization of liquid in the pipe 97.

The vessel 53 is connected with the outlet of a pipe 64 which supplies water. The level of liquid which forms the body 54 is controlled by a float forming part of a valve 66 at the outlet end of the pipe 64. The aforementioned tube 67 which supplies steam to the coil of the heat exchanger 56 in the vessel 53 has a branch 68 for delivery of steam to the coil of the heat exchanger 51. A further tube 69 receives steam from the tube 67 for delivery to the coil of the heat exchanger 62. The tubes 68, 69 respectively contain valves 73, 74 which are adjustable by electric servomotors 71, 72. A condensate collecting and evacuating tube 76 is connected with the coils of heat exchangers 51, 56 and 62 by branch tubes 76*a*, 76*b*, 76*c* which respectively contain steam condensers 77, 79, 78.

The air conditioning unit 48 constitutes with the heat exchanger 62 (this heat exchanger is controlled by the moisture measuring device 39) and with the spray nozzles 63 an adjustable conditioning device for regulating or controlling the amount of moisture which is contained in the air current entering the drum 21 through the outlet of the conduit 28.

The nozzle 31 in the inlet end A of the drum 21 receives water from the pipe 64 by way of a branch pipe 81 containing a valve 86 which is adjustable by a manually operable wheel 83 or the like. The nozzle 32 receives steam from the tube 67 by way of a branch tube 82 containing a valve 87 which is adjustable by a handwheel 84 or the like. It will be noted that the moisturizing action of agents (water and steam) furnished by the nozzles 31, 32 is independent of the moisturizing action of the current of air in the conditioning zone C.

The temperature detector 52 in the conduit 28 transmits electric signals to a PID regulator 88 for the servomotor 71 which serves to adjust the valve 73. The regulator 88 is further connected with an adjustable potentiometer 89 which constitutes a rated value selector, i.e., a device which determines the temperature of the current of air issuing from the conduit 28. The regulator 88 comprises one or more amplifiers and transmits to the servomotor 71 signals when the signal which is furnished by the temperature detector 52 deviates from the output signal of the potentiometer 89. The valve 73 increases the rate of steam circulation in the coil of the heat exchanger 51 when the temperature of air in the conduit 28 is less than that selected by the potentiometer 89, and vice versa. The parts 71, 73, 88 together constitute a means for adjusting the heat exchanger 51 when the measured temperature of air (see the detector 52) deviates from a predetermined temperature selected by the potentiometer 89.

The output of the transducer 42 in the moisture measuring device 39 is connected with a signal comparing junction 91 of known design which is further connected with a potentiometer 92 constituting a rated value selector for the temperature of water which is being fed to the spray nozzles 63 in the vessel 53. The junction 91 transmits to a PID regulator 93 a signal whose intensity is proportional to the difference between the intensities of signals furnished by the transducer 42 and potentiometer 92. The output of the PID regulator 93 is connected to one input of a junction 94 which further receives signals from a temperature detector 96 in the pipe 97 and from two outputs of a program circuit 99*a*. The output of the junction 94 transmits to a PID regulator 98 a signal whose intensity is proportional to the difference between the intensities of signals from the regulator 93 and detector 96. The regulator 98 amplifies the signal from the junction 94 and transmits it to the servomotor 72 for the valve 74 in the tube 69.

The junctions 91, 94 constitute with the motor 72 and valve 74 an adjusting means which determines the quantity of liquid in the current of heated air flowing into the inlet end A of the drum 21 by way of the conduit 28. The means 91, 94, 72, 74 serves to adjust the conditioning means 48, 62, 63 and is operatively connected with the moisture measuring device or detector 39 as well as with the potentiometer 92 so that the extent of adjustment of the conditioning means is a function of the difference between the measured final moisture content (detector 39) and the desired final moisture content (potentiometer 92).

The weighing device 14 not only serves to measure the quantity of tobacco leaves in unit lengths of the stream which is supplied by the carded conveyor 7 but also as a means for detecting the leading end of the tobacco stream 20 after the conveyor 5 receives a fresh bale 4 and the conveyors 5, 9, 7, 14*a* are set in motion to feed tobacco leaves into the magazine 8 as well as to withdraw from the magazine a substantially constant stream which travels with the upper stretch of the conveyor belt 14*a*. The signals which appear at the output of the transducer 15 are further transmitted to one input of the program circuit 99*a*.

Analogously, the moisture measuring device or detector 39 serves the additional purpose of furnishing signals which indicate that the leading end of the conditioned stream 20' of tobacco leaves has reached the vibrating trough 38. The signals from the transducer 42 of the moisture measuring device 39 are transmitted to the program circuit 99*a* by way of a threshold circuit 100 and a further program circuit 99*b*. The threshold circuit 100 transmits a signal when it receives a signal whose intensity exceeds a predetermined minimum value.

The fixed sequence of operations which are carried out by the program circuits 99*a*, 99*b* is as follows: These circuits respond to signals from the weighing device 14 (transducer 15) and moisture measuring device 39 (transducer 42). When the devices 14 and 39 do not transmit signals which indicate that tobacco leaves travel with the upper stretch of the conveyor belt 14*a* or in the trough 38 (i.e., when a bale 4 on the conveyor 5 has been consumed and the operator(s) or an automatic feeder has failed to place a fresh bale 4 onto the conveyor 5 immediately upon consumption of the preceding bale), the program circuit 99*a* transmits to the junction 94 (via conductor 99*c*) a signal whose intensity is lower than that of a signal which is needed to effect the heating of liquid (heat exchanger 62) to a normal or average value. Thus, the heating of liquid which is being drawn from the vessel 53 by pump 61 and passes through the heat exchanger 62 is less pronounced than when a stream of tobacco leaves actually passes through the conditioning zone C.

The program circuit 99*a* further transmits signals to the electromagnets 45, 50 for the valves 47, 49 which cause the air flowing from the fan 46 to bypass the space above the body 54 of liquid in the vessel 53. The air flows through a bypass line 95 which is connected between the valves 47, 49 outside of the vessel 53.

When the weighing device 14 (and more particularly its transducer 15) transmits a signal which indicates that the leading end of the stream of tobacco leaves has reached the conveyor belt 14*a*, while the transducer 42 of the moisture measuring device 39 continues to transmit a "no tobacco" signal, the program circuit 99*a* transmits to the junction 94 a signal by way of a discrete conductor 99*d*. Such signal from the circuit 99*a* is indicative of the average temperature of water which flows in the pipe 69, i.e., of the temperature which is anticipated for normal operation of the apparatus. At the same time, the signal from the program circuit 99*a* to the electromagnets 45, 50 for the valves 47, 49 is changed so that the valves 47, 49 seal the bypass conduit 95 from the fan 46 and conduit 28 while allowing air to flow from the fan 46 into the vessel 53 and from the vessel 53 into the conduit 28.

When the transducer 42 furnishes to the threshold circuit 100 a signal which indicates that tobacco leaves pass through the vibrating trough 38 of the moisture measuring device 39, while the transducer 15 continues to supply to the program circuit 99*a* a signal indicating the presence of tobacco leaves on the conveyor belt 14*a*, the circuit 99*a* ceases to transmit a signal by way of the conductor 99*d* whereby the device 39 takes over and regulates the temperature of water which flows in the pipe 97. This takes place only when the transducer 42 transmits to the threshold circuit 100 a signal whose intensity exceeds the aforementioned predetermined minimum value, i.e., a signal which indicates the flow of a constant stream 20° of conditioned tobacco leaves toward the take-off conveyor 41.

The operation of the apparatus of FIG. 1 is as follows:

When the apparatus is started and a fresh bale 4 is placed onto the upper stretch of the conveyor 5, the carding of the conveyor 9 begins to feed into the magazine 8 a stream 3 wherein the quantity of tobacco leaves per unit length can fluctuate within a rather wide range. The photoelectric detector means 11 contributes to a coarse equalization of the stream 3 by cooperating with the control circuit 12 to regulate the speed of the conveyors 5 and 9 so as to accelerate the motor 13 when the supply of tobacco leaves in the magazine is depleted to a preselected minimum level and to decelerate the motor 13 when the supply of leaves in the magazine 8 rises to a preselected maximum level. The carding of the conveyor 7 draws from the magazine 8 a stream 20 wherein the quantity of tobacco leaves per unit length fluctuates little or not at all. This is attributable to the fact that the level of the supply of tobacco leaves in the magazine 8 is substantially constant. Further equalization of the stream 20 of tobacco leaves is effected by the weighing device 14 whose transducer 15 causes the control circuit 16 to automatically change (increase or decrease) the speed of the motor 17 and conveyor 7 when the measured quantity of tobacco leaves on the conveyor belt 14*a* deviates from a predetermined quantity.

Successive increments of the stream 20 enter into and advance along the chute 26 and move into the range of projections on the rapidly rotating winnower roller 33 at the inlet end A of the rotating drum 21. The winnower roller 33 converts the stream 20 into a shower 34 whose particles travel along arcuate paths and are contacted by moisturizing agents (water and steam) issuing from the orifices of the nozzles 31, 32. The conduit 28 discharges a continuous current of hot humid air which flows concurrent with tobacco leaves in the drum 21 and is collected in the hood 29*a* for evacuation by way of the conduit 29. The tobacco leaves in the drum 21 advance toward the discharge end B because the drum 21 rotates and its axis of rotation is inclined downwardly, as seen from the inlet end A toward the discharge end B.

Conditioned tobacco leaves enter the chute 27 and form the stream 20' which travels with the upper stretch of the transfer conveyor 36 prior to entering the vibrating trough 38 of the moisture measuring device 39. The trough 38 delivers tobacco leaves to the take-off conveyor 41 which feeds the leaves into a destalking machine, not shown. The duration of exchange of heat and moisture between air and tobacco leaves during concurrent flow through the conditioning zone C is long enough to insure that the temperature and moisture content of tobacco leaves at the discharge end B respectively equal the temperature and moisture content of air in the hood 29*a*. This insures that such characteristics of tobacco leaves in the stream 20' match the desired optimum characteristics.

The regulation of heating and moisturizing actions to which the tobacco leaves are subjected in the conditioning zone C is as follows:

If the magazine 8 is empty so that the conveyor 7 does not transport a stream 20 of tobacco leaves onto the conveyor belt 14*a*, the signal (or the absence of signal) from the transducer 15 of the weighing device 14 to the program circuit 99*a* indicates the absence of tobacco at the weighing station. A similar signal is transmitted to the program circuit 99*a* from the transducer 42 of the moisture measuring device 39. This means that the conduit 28 should not supply humid air because it would cause excessive moisturizing of the conditioning zone C. The program circuit 99*a* transmits a signal to the electromagnets 45, 50 which reset the valves 47, 49 in such a way that the current of air issuing from the fan 46 passes through the conduit 95 without entering the space above the body 54 of liquid in the vessel 53. The current of air flows from the conduit 95, through the valve 49, and into the heat exchanger 51 to be heated therein to a temperature which is determined by the potentiometer 89. As explained above, the temperature of the current of air in the conduit 28 is monitored by the detector 52 which causes the PID regulator 88 to adjust the servomotor 71 for the valve 73 when the intensity of signals which the regulator 88 receives from the detector 52 deviates from the intensity of signals transmitted by the potentiometer 89. The valve 73 controls the rate of steam circulation in the coil of the heat exchanger 51 and hence the temperature of air in the conduit 28.

The program circuit 99*a* further transmits a signal to the junction 94 (conductor 99*c*) which utilizes such signal for appropriate preliminary adjustment of the valve 74 by way of the PID regulator 98 and servomotor 72. The signal from the temperature detector 96 to the junction 94 is compared with the signal which is transmitted via conductor 99*c*, and the servomotor 72 adjusts the valve 74 whenever the intensities of the two signals are not identical so that steam which circulates in the coil of the heat exchanger 62 can effect a more or less pronounced heating of water in the pipe 97. The valves 86, 87 are assumed to be closed so that the nozzles 31, 32 do not discharge sprays of fluid.

When the stream of tobacco reaches the conveyor belt 14 (i.e., shortly before the leaves reach the inlet end A of the drum 21), the transducer 15 transmits to the program circuit 99*a* a signal which is indicative of the presence of tobacco leaves in the weighing device 14. The circuit 99*a* then erases the signal at the output which is connected to the conductor 99*c* and transmits to the junction 94 a different signal via conductor 99*d*. Such signal causes the junction 94 to change the setting of the valve 74 by way of the servomotor 72 and regulator 98 so that the heat exchanger 62 in the pipe 97 subjects the stream of water in the pipe 97 to a more intensive heating action, namely a heating action which is needed to maintain water in the pipe 97 at a temperature corresponding to average temperature during normal operation of the apparatus. In other words, water in the pipe 97 is heated to a temperature which is needed to insure a satisfactory conditioning of air flowing into the conduit 28 while the chute 26 admits into the inlet end A of the drum 21 tobacco leaves having an average initial moisture content and being supplied at an average rate.

The transmission of a signal via conductor 99*d* begins simultaneously with such adjustment of valves 47, 49 (by way of the servomotors 45, 50 and conductor means connecting these servomotors with the circuit 99*a*) that the current of air issuing from the fan 46 cannot enter the conduit 95 but is compelled to flow through the upper part of the vessel 53. On its way across the space above the body 54 of liquid, the current of air must pass through hot water sprays produced by the nozzles 63 whereby its moisture content increases considerably prior to passing through the heat exchanger 51 wherein its temperature increases to a value which is determined by the setting of the potentiometer 89 (e.g., to about 100° C). Deviations from such selected temperature are detected by the detector 52 which causes the servomotor 71 to adjust the valve 73 so as to increase or reduce the rate of steam circulation in the coil of the heat exchanger 51.

The thus heated and moisturized current of air passes through the conduit 28 and is discharged into the drum 21 to exchange heat and moisture with tobacco leaves which descend in the conditioning zone after having been propelled by the winnower roller 33. The leaves enter the inlet end A at a constant rate because they form part of the "equalized" tobacco stream 20 which is supplied into the chute 26 by the conveyor belt 14*a* of the weighing and metering device 14. As mentioned above, the flow of air from the conduit 28 to the hood 29*a* and conduit 29 is concurrent with the direction of tobacco transport in the conditioning zone C.

The valves 86, 87 are opened by hand (see the adjusting wheels 83, 84) or automatically in response to a signal from the program circuit 99*a* via conductor 99*d* so that the nozzles 31, 32 respectively begin to discharge sprays of water and steam into the shower 34 of tobacco leaves which are about to come into contact with air issuing from the conduit 28. It will be noted that the fluids issuing from the nozzles 31, 32 effect a preliminary or initial moistening of tobacco leaves so that the moisture content of tobacco leaves which are being contacted by the air current issuing from the conduit 28 can be much closer to the desired final moisture content (as selected by the setting of the potentiometer 92) than the moisture content of tobacco leaves in the magazine 8.

The exchange of heat and moisture between air and tobacco leaves is especially pronounced in the region close to the inlet end A of the drum 21 because the temperature of air leaving the conduit 28 is normally much higher than the temperature of tobacco. Consequently, the dew point of the current of air entering the zone C decreases practically immediately and the steam is converted into condensate which is deposited on the tobacco leaves. The air which flows in the right-hand portion of the zone C is in hygroscopic equilibrium with tobacco leaves; this insures that the conditioning of all leaves and of all portions of all leaves is the same not later than when the leaves enter the chute 27. Such uniform conditioning of all leaves constitutes an important feature of our invention.

When the leading end of the stream 20′ of conditioned tobacco leaves reaches the vibrating trough 38 of the moisture measuring device 39, the transducer 42 transmits a signal not only to the junction 91 but also to the threshold circuit 100. Such signal indicates that the starting of the apparatus is completed, i.e., that an uninterrupted stream or shower of tobacco leaves is in motion from the magazine 8 and all the way to the take-off conveyor 41. The circuit 100 transmits a signal to the program circuits 99*b*, 99*a* as soon as the intensity of signal furnished by the transducer 42 indicates that the rate of feed of tobacco leaves into the trough 38 is normal, i.e., as soon as the intensity of signal at the input of the circuit 100 exceeds a predetermined minimum value. The signal from the program circuit 99*a* to the junction 94 via conductor 99*d* disappears so that, from then on, the position of the valve 74 is changed only when the intensity of signals from the transducer 42 to the junction 91 differs from the intensity of signals which the junction 91 receives from the potentiometer 92. The signals which the junction 94 and regulator 98 transmit to the servomotor 72 may be positive or negative signals, i.e., they can cause the valve 74 to increase or reduce the rate of steam circulation in the coil of the heat exchanger 62. If the final moisture content of tobacco leaves which form the stream 20′ exceeds the moisture content which is selected by the potentiometer 92, the heating action upon the water stream passing through the heat exchanger 62 is reduced so that the temperature of water sprays issuing from the nozzles 63 decreases and the air current flowing across the vessel 53 contains a lower percentage of moisture. However, the temperature of air which flows in the conduit 28 remains the same (see the temperature detector 52) because the setting of the potentiometer 89 remains unchanged.

If the final moisture content of tobacco leaves which form the stream 20′ is less than the desired moisture content, the heat exchanger 62 increases the temperature of water which is sprayed into the vessel 53 and the moisture content of air in the conduit 28 increases.

An advantage of the heat exchanger 51 is that it compensates for those fluctuations of the temperature of air passing through the upper portion of the vessel 53 which develop as a result of changes in the temperature of water sprays issuing from the nozzles 63. The temperature of air which is admitted into the conditioning zone C via conduit 28 not only influences the exchange of moisture between air and tobacco leaves in the drum 21 but also the relative humidity of air in the conduit 28. The conditioning of tobacco leaves in the zone C can be carried out with a much higher degree of accuracy and reproducibility if only one parameter or characteristic of the air current (namely, its moisture content) is variable (by changing the temperature of steam in the coil of the heat exchanger 62 as a function of differences between the measured and desired final moisture content of tobacco leaves), whereas the other parameters of air (including its temperature at the discharge end of the conduit 28) remain unchanged.

The provision of an endless path wherein the current of air circulates in such a way that it is at least substantially sealed from the surrounding atmosphere is desirable because such circulation of air brings about substantial savings in energy. This will be readily appreciated by considering that the temperature of air in the conduit 28 is as high as or may exceed 100° C. Moreover, the current of air which exchanges heat and moisture with tobacco leaves in the drum 21 acquires a pungent odor which is unpleasant to the occupants of the tobacco conditioning plant, the same as the relatively high moisture content and temperature of such air.

The controlled heating and moisturizing of air which exchanges heat and moisture with tobacco leaves in the conditioning zone C constitutes the most expensive stage of the conditioning operation and must be carried out by resorting to devices which constitute the most complex and perhaps the bulkiest parts of the improved apparatus. The provision of auxiliary moisturizing means including the nozzle 31, 32 contributes to the substantial reduction of the cost of heating and moisturizing air which enters the conditioning zone C via conduit 28 because the cost of conditioning the current of air decreases proportionally with a reduction of the difference between the moisture content of tobacco leaves which are about to be contacted by the air current and the final moisture content of such leaves. Thus, the moisturizing agents issuing from the nozzles 31, 32 reduce the cost of conditioning air in the unit 48 and heat exchanger 51, and such reduction of cost is more pronounced if the preliminary moistening of tobacco leaves raises the moisture content to a value which is close to or nearly equals the desired final moisture content. Nevertheless, the adjustment of valves 86 and 87 is preferably such that the moisture content of tobacco leaves which have passed through the showers of media supplied by the nozzles 31, 32 and are about to be contacted by the current of air issuing from the conduit 28 is invariably less than the desired final moisture content. This means that, when the initial moisture content of tobacco leaves fluctuates within a wide range whose upper limit is close to and whose lower limit is well below the desired final moisture content, the valves 86 and 87 admit to the nozzles 31, 32 relatively small quantities of water and steam.

The circulation of a current of air along an endless path a portion of which is defined by the drum 21 bring about savings in energy because the temperature and humidity of air leaving the conditioning zone C via hood 29a and evacuating conduit 29 are normally much higher than the temperature and humidity of surrounding atmospheric air. Consequently, the energy requirements of the heat exchanger 62 (which raises the humidity of air in the vessel 53) and heat exchanger 51 (which increases the temperature of air in the conduit 28) are much lower than if the fan 46 were to draw cool and relatively dry air directly from the atmosphere.

Figure 2:
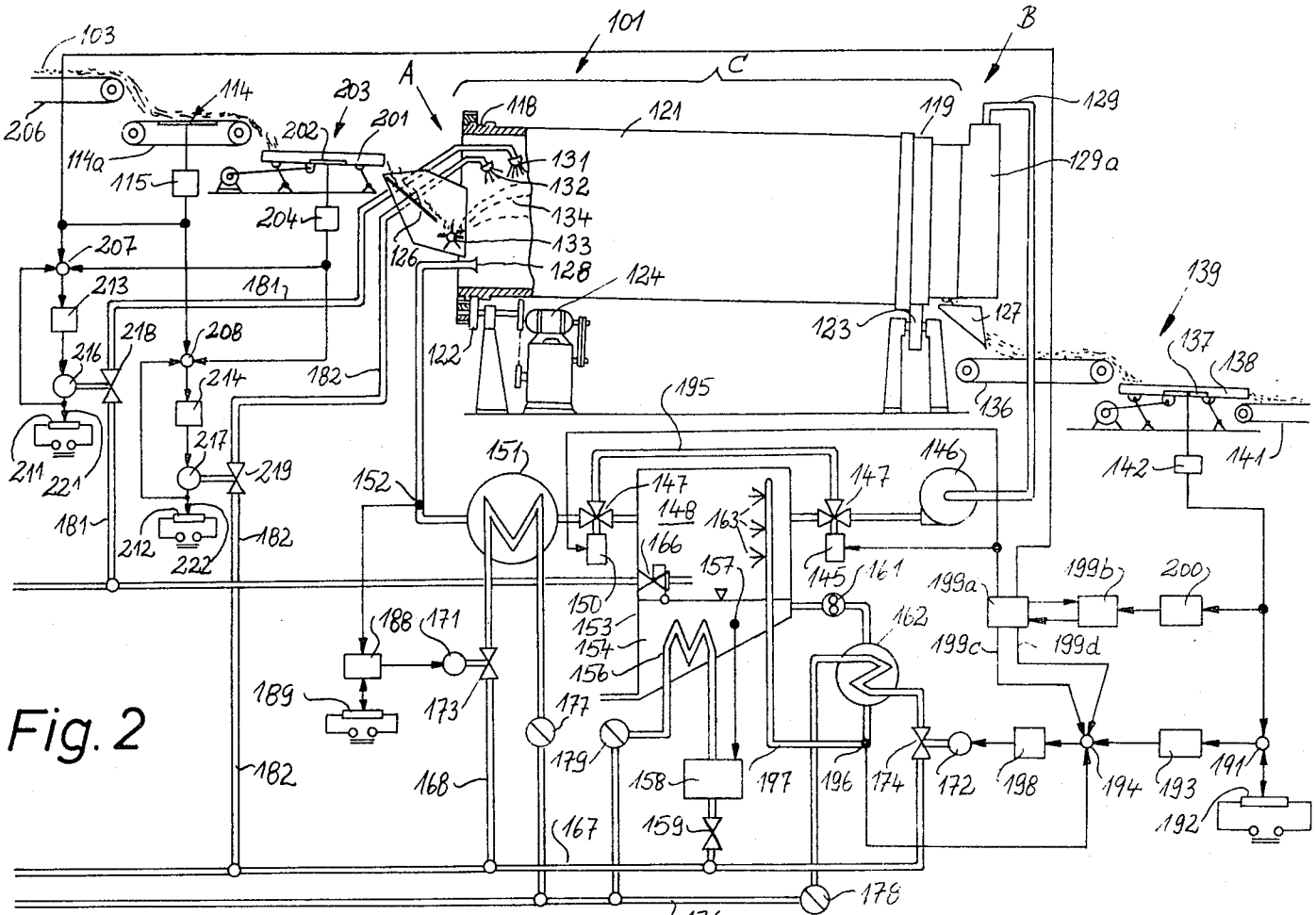
FIG. 2 is a similar view of a second apparatus wherein the preliminary wetting of fibrous material is regulated automatically as a function of changes in throughput and initial moisture content of fibrous material.

FIG. 2 illustrates a second apparatus wherein all such parts which are identical with or clearly analogous to the corresponding parts of the apparatus of FIG. 1 are denoted by similar reference characters plus 100. An important difference between the two apparatus is that the rate of admission of water and steam by way of the nozzles 131, 132 shown in FIG. 2 is automatically adjustable as a function of fluctuations in the rate of feed of tobacco leaves into the inlet end A of the revolving drum 121 and as a function of changes in the initial moisture content of tobacco leaves. Thus, the preliminary wetting of tobacco leaves which takes place prior to entry of tobacco leaves into the current of hot humid air issuing from the conduit 128 is regulatable to account for the fact that the weighing device 114 does not contribute to an equalization of the rate of tobacco transport into the conditioning zone C. Moreover, the preliminary wetting of tobacco in the apparatus of FIG. 2 can be regulated as a function of eventual fluctuations of moisture content of tobacco which is being fed into the chute 126 for entry into the drum 121.

The weighing device 114 serves as a means for indicating the arrival of the leading end of a stream of tobacco leaves, as a means for indicating the presence of absence of tobacco leaves, and as a means for producing electric signals whose intensity is proportional to the quantity of tobacco leaves in unit length of an unequalized tobacco stream 103 which is supplied by an endless conveyor 206. The endless conveyor belt **114*a* of the weighing device 114 delivers tobacco leaves into the vibrating trough 201 of a moisture measuring device or detector 203 which is similar to or identical with the device 139 and further comprises capacitor means 202 and a transducer 204 serving to generate electric signals whose intensity is proportional to the moisture content of successive increments of the tobacco stream 103 in the trough 201. The devices 203 and 139** respectively monitor the initial and final moisture content of tobacco leaves.

The signals which are generated by the transducers 204 and 115 are transmitted to signal comparing junctions 207, 208. Such signals are respectively indicative of the measured initial moisture content of tobacco leaves (device 203) and of the measured rate of tobacco feed (device 114). The junctions 207 and 208 have additional inputs which respectively receive signals from potentiometers 211, 212. The potentiometer 211 is adjustable and serves to transmit signals which are indicative of a selected or desired rate of admission of atomized liquid moistening agent by way of the orifices of the nozzle 131, and the potentiometer 212 is set to furnish signals which indicate the desired rate of steam admission via nozzle 132 when the rate of tobacco feed is constant.

The junction 207 transmits to an amplifier 213 signals whose intensity corresponds to the difference between the intensities of signals from the transducers 204, 115 and potentiometer 211. The amplifier 213 controls a motor 216 for an adjustable valve 218 in th branch pipe 181. The junction 208 transmits signals to an amplifier 214 for a motor 217 which serves to adjust a valve 219 in the branch tube 182. The sliding contacts 221, 222 of the potentiometers 211, 222 are adjustable by the motors 216, 217 so that each of their positions respectively corresponds to a different adjustment of the valves 218, 219.

The operation of the apparatus of FIG. 2:

The conveyor 206 transports a stream 103 of tobacco leaves wherein the quantity of tobacco fluctuates much more than in the stream 20 of FIG. 1 because the apparatus of FIG. 2 does not comprise an exact equivalent of the feeding and metering device 2 shown in FIG. 1. The weighing device 114 furnishes signals which indicate the quantity of tobacco leaves per unit length of the stream 103, and the device 203 furnishes signals which indicate the initial moisture content of successive increments of the stream 103. The aforedescribed elements shown in the left-hand portion of FIG. 2 are responsive to such signals and adjust the valves 218, 219 in such a way that the preliminary wetting of tobacco leaves with water and steam in the conditioning zone C varies as a function of changes in throughput and initial moisture content of tobacco leaves. In other respects, the operation of the apparatus shown in FIG. 2 is identical with that of the apparatus of FIG. 1. Thus, the devices 114, 139 can transmit signals to the program circuits 199*a*, 199*b* during travel of the leading end of a fresh stream toward and onto the conveyor belt 114*a* and trough 138, and the device 139 regulates the percentage of moisture in hot air flowing in the conduit 128 when the leading end of the stream of tobacco leaves reaches and advances beyond the trough 138.

The apparatus of FIG. 2 can be modified in a number of ways. For example, the means for regulating the rate of flow of water and steam to the nozzles 131, 132 can be omitted if the apparatus is provided with an equalizing device which is installed between the weighing device 114 and the inlet end A of the drum 121. Such equalizing device contributes to a substantial simplification of the apparatus because the conditioning in zone C then varies only as a function of deviations of the final moisture content from a desired moisture content, i.e., the conditioning of tobacco leaves with air issuing from the conduit 128 need not be regulated additionally as a function of fluctuations in the throughput of tobacco leaves. The equalizing means between the weighing device 114 and drum 121 may be similar to that shown in FIG. 1, i.e., it may comprise a magazine and a carded conveyor.

The apparatus of FIG. 2 exhibits the important advantage that the moistening agents supplied by the nozzles 131, 132 can raise the moisture content of tobacco leaves to a value which is only slightly below the desired final moisture content, so that the current of hot humid air issuing from the conduit 128 merely serves to slightly increase the moisture content of tobacco leaves during concurrent flow toward the discharge end B of the drum 121 with attendant savings in energy requirements of the air conditioning unit 148 and heat exchanger 151. This is due to the fact that the quantities of additional moisture supplied by the nozzles 131, 132 are regulated in dependency on changes in the initial moisture content of tobacco leaves (measuring device or detector 203) and also in dependency on changes in the rate of tobacco delivery to the chute 126 (weighing device 114). The latter feature of regulation of the rate of admission of additional moisture is desirable because the total quantity of additional moisture which is to be added per unit of time depends on the initial moisture content of tobacco as well as on the mass of that portion of the stream of tobacco leaves which is about to enter the conditioning zone C. As mentioned before, the adjustment of the rate of admission of additional moisture via nozzles 131, 132 can be simplified (by omitting the connections between the transducer 115 and junctions 207, 208 as well as by replacing these junctions with simpler signal comparing circuits) if the tobacco stream 103 is equalized in a region ahead of the conditioning zone C.

Figure 3:
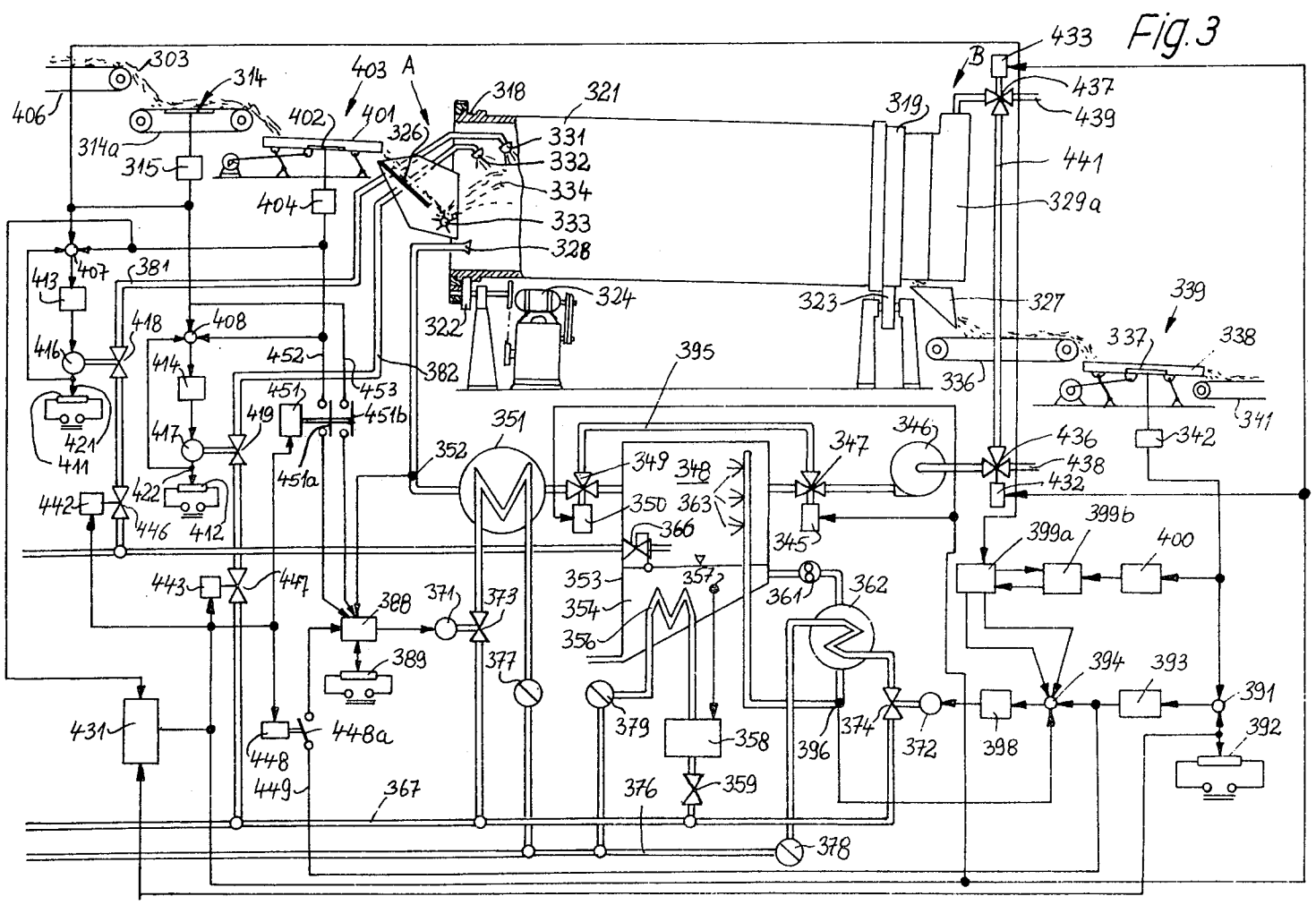
FIG. 3 is a similar diagrammatic view of a third apparatus which can be used for automatic increase or reduction of moisture content of fibrous material.

The apparatus of FIG. 3 is designed to change the moisture content of tobacco whose initial moisture content is less than or exceeds the desired final moisture content. The initial moisture content will exceed the final moisture content if the stream 303 of tobacco on the conveyor 406 of FIG. 3 has already passed through a wetting station wherein its moisture content (preliminary wetting) has been increased without simultaneous measurement so that the moisture content of portions of or the entire stream 303 exceeds the desired final moisture content. In such instances, the treatment in accordance with the invention involves a drying of tobacco in order to reduce (rather than increase) its moisture content to a desired final value.

All such parts of the apparatus of FIG. 3 which are identical with or clearly analogous to the corresponding parts of the apparatus of FIG. 2 are denoted by similar reference characters plus 200. The lower left-hand portion of FIG. 3 shows a signal comparing circuit 431 which is a threshold circuit and transmits a signal in response to a signal from the transducer 404 of the moisture measuring device or detector 403, provided that the intensity of signal from the transducer 404 exceeds the intensity of signal from the potentiometer 392. In other words, the output of the circuit 431 transmits a signal when the initial moisture content of tobacco leaves forming the stream 303 is higher than the desired final moisture content. The signal from the circuit 431 is transmitted to electromagnets 432, 433 for valves 436, 437 which serve to open the normally closed path for circulation of heated and moisturized air. The valve 436 is mounted upstream of the fan 346 and has a port 438 which enables the fan 346 to draw air from the atmosphere (instead of from the hood 329*a*) when the electromagnet 432 is energized in response to a signal from the circuit 431. The valve 437 is mounted between the hood 329*a* and the valve 436 and has a port 439 which discharges air into the atmosphere when the electromagnet 433 is energized in response to a signal from the circuit 431. Thus, the fan 346 draws air via port 439. The conduit 441 between the valves 436, 437 is then sealed at both ends.

The output signal from the circuit 431 is further transmitted to electromagnets 442, 443 for valves 446, 447 which are respectively installed in the branch pipe 381 and branch tube 382. Such signal causes the electromagnets 442, 443 to close the respective valves 446, 447 so that the nozzle 331 does not receive water and the nozzle 332 does not receive steam.

Still further, the output signal from the circuit 431 is transmitted to a relay 448 having a switch 448*a* in a conductor 449 connecting the PID regulator 393 with the PID regulator 388. The conductor 449 transmits signals which indicate or are proportional to the measured final moisture content, and the switch 448*a* closes when the relay 448 receives a signal from the circuit 431.

The output signal from the circuit 431 is also transmitted to a relay 451 having switches 451*a*, 451*b*, which are respectively installed in conductors 452, 453. The conductor 452 transmits signals from the transducer 404 of the moisture measuring device 403 to the PID regulator 388, and the conductor 453 transmits signals from the transducer 315 of the weighing device 314 to the regulator 388. The switches 451*a*, 451*b* close in response to transmission of a signal from the circuit 431 to the relay 451.

The circuit 431 constitutes with the valves 446, 447 and relays 448, 451 and valves 436, 437 a switchover device which prevents further moistening of tobacco when the device 403 determines that the initial moisture content exceeds the desired final moisture content. The electromagnets 345, 350 constitute a control means which is operatively connected with the output of the circuit 431 and serves to adjust the air conditioning means (and more particularly the valves 347, 349) so as to reduce the moisture content of air when the signal furnished by the circuit 431 indicates that the initial moisture content of tobacco leaves (as measured by the device 403) exceeds a predetermined value, i.e., the desired final moisture content selected by the potentiometer 392.

The operation of the apparatus of FIG. 3:

When the initial moisture content of tobacco leaves is les than the desired final moisture content, the treatment of tobacco leaves is identical with that in the apparatus of FIG. 2. If the initial moisture content is higher than the desired final moisture content, the circuit 431 transmits a signal to the electromagnets 442, 443 to close the valves 446, 447 and to thus interrupt or prevent the flow of fluid to the nozzles 331, 332. The output signal from the circuit 431 is further transmitted to the electromagnets 345, 350 which cause the valves 347, 349 to seal the vessel 353 from the fan 346 so that the current of air flows through the conduit 395. Also, the valves 436, 437 are actuated by electromagnets 432, 433 (which are also connected to the output of the circuit 431) so that the fan 346 draws atmospheric air via port 438 and the port 439 discharges air from the hood 329*a* into the atmosphere. The relays 448 and 451 are energized and respectively close the switches 448*a* and 451*a*, 451*b*. Thus, the regulator 388 is connected with the transducers 342, 404 and 315, i.e., it receives signals from the moisture measuring devices 339, 403 and weighing device 314. As explained in connection with the regulator 88 of FIG. 1, the regulator 388 controls the temperature of air in the conduit 328 by regulating the rate of steam circulation in the coil of the heat exchanger 351. It will be seen that the drying of tobacco leaves begins in immediate response to detection of excessively moisturized tobacco leaves by the device 403. Such drying is regulated at first in dependency on the rate of feed of excessively moist tobacco leaves (weighing device 314) and the initial moisture content (moisture measuring device 403), and thereupon also in dependency on the measured final moisture content (device 339).

During drying of tobacco leaves having an excessive moisture content, the temperature of conditioning air does not remain in constant but is caused to change as a function of changes in initial and final moisture content as well as in dependency on the changes in throughput of tobacco leaves.

It is clear that the apparatus of FIG. 3 can be modified so that the temperature of conditioning air changes only as a function of one or two of the just enumerated parameters, e.g., as a function of changes in initial and/or final moisture content, as a function of changes in throughput, as a function of changes in throughput and initial moisture content, or as a function of changes in throughput and final moisture content.

When the conveyor 406 begins to deliver tobacco leaves whose initial moisture content is less than the desired final moisture content, the signal at the output of the circuit 431 disappears and the apparatus begins to operate in the same way as the apparatus of FIG. 2.

An important advantage of the improved apparatus is that the temperature and moisture content of one or more air currents flowing in the conditioning zone concurrent with the tobacco stream can be regulated with a high degree of accuracy to thus insure a uniform conditioning of tobacco in a small area, in a fully automatic way, and regardless of minor or even substantial fluctuations in throughput and/or initial moisture content of tobacco. Such conditioning is beneficial in the course of further treatment to which tobacco is subjected prior to conversion into smokers' products.

Another advantage of the improved apparatus is that the fibrous material is subjected to a preliminary conditioning (nozzles 31, 32 or 131, 132 or 331, 332) which insures that the current of air which flows through the zone C concurrent with fibrous material need not perform all of the work which is needed to insure that all increments of the stream leaving the zone C will have a predetermined final moisture content. In other words, the preliminary wetting with water and/or steam can increase the initial moisture content to such an extent that the increased moisture content closely approximates the desired final moisture content; the air current issuing from the conduit 28, 128 or 328 then merely insures that each and every increment of the conditioned stream will have a moisture content which equals the desired final moisture content. In such cases, the air current merely insures a complete homogenization of the moisture content in the stream of fibrous material which leaves the conditioning zone C so that the particles of fibrous material travelling in the downstream region of the zone C (close to the discharge and B) are in hygroscopic equilibrium with the current of air which is about to enter the hood 29*a*, 129*a* or 329*a*.

The effect of preliminary conditioning can be improved still further if the rate of admission of water and/or steam (nozzles 131, 132) is regulated in a manner as described in connection with FIG. 2. An advantage of the apparatus of FIG. 3 is that it can properly condition tobacco or other fibrous material whose initial moisture content is higher or lower than the desired final moisture content and that such versatility of the apparatus is achieved with a minimal outlay for additional parts.

The program circuits 99*a*–99*b*, 199*a*–199*b* and 399*a*–399*b* serve to insure that the various components and units of the respective apparatus are started in a proper sequence during automatic starting of a tobacco conditioning operation. These circuits render it possible to place onto the conveyor 5 of FIG. 1 a bale 4 of compacted tobacco leaves or to admit tobacco leaves onto the conveyor 206 or 406 without necessitating any supervision of the sequence in which the components of the apparatus begin to operate in order to effect a desired moistening of leaves to a predetermined moisture content. The sole exception are the valves 86, 87 which, in the embodiment of FIG. 1, are assumed to be adjustable by hand. The program circuits, in cooperation with the parts which supply signals thereto, insure that the current of air is properly heated and moisturized as soon as the steam of tobacco reaches the cnditioning zone, that the operation with the adjustment of moisture content of air in dependency on deviations of the measured final moisture content of tobacco leaves from the desired final moisture content begins as soon as the leading end of the tobacco stream reaches the moisture measuring device 39, 139 or 339, as well as that the leading end of the tobacco stream (while on its way from the detector or detectors upstream of the conditioning zone to the detector means downstream of the conditioning zone) is caused to change its moisture content in such a way that, under normal circumstances, the measured final moisture content does not deviate appreciably from the desired final moisture content.

To summarize the operation of the program circuits (with reference to FIG. 3), these circuits perform the following functions:

In the absence of signals from the transducers 404 and 342 (indicating the absence of tobacco leaves in the troughs 401 and 328), the valve 373 reduces the rate of circulation of steam in the coil of the heat exchanger 351 so that the temperature of the air current issuing from the conduit 328 is lower than under normal operating conditions. Also, the air current bypasses the vessel 353 so that it does not undergo a moisturizing treatment by the sprays of water issuing from the nozzles 363.

If the transducer 404 furnishes a signal with indicates that tobacco leaves advance in the trough 401 but the signal (or the absence of signal) from the transducer 342 continues to indicate the absence of tobacco leaves in the trough 338, the valve 374 is adjusted with a view to insure that the moisture content of air issuing from the conduit 328 will equal or approximate an average value which has been determined to be best suited for changing the moisture content of tobacco leaves having an average (anticipated) initial moisture content to a desired final moisture content.

If the program circuits receives signals simultaneously from the transducers 404 and 342, this indicates that the stream of tobacco fills the entire path which is defined by the conveyor system 406, 314*a*, 401, 326, 321, 327, 336, 338, 341. The operation of the heat exchanger 351 is then controlled exclusively by the detector 352, the rate of admission of additional moisture via nozzles 331, 332 is then regulated exclusively in response to signals from the transducers 315, 404, and the moisture content of the air current in the conduit 328 is then controlled exclusively by signals from the detector 396, potentiometer 392 and transducer 342.

The exact details of program circuits which are used in the apparatus of FIGS. 1, 2 or 3 form no part of the invention. Such circuits can be assembled by men skilled in the art from commercially available components, such as switches, capacitors, time-delay relays, transistor and/or others.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. Apparatus for changing the moisture content of tobacco or analogous fibrous material, comprising conveyor means arranged to advance a stream of fibrous material along a first path including a conditioning zone having an inlet end and an outlet end; adjustable auxiliary moisturizing means operable to admit moisture to fibrous material at the inlet end of said zone; means for conveying a current of hot and normally humid gaseous fluid along a second path a first portion of which coincides substantially with the entire conditioning zone and wherein said fluid flows concurrent with fibrous material; adjustable conditioning means for changing the moisture content of said fluid in a second portion of said second path so that the moisture content of said fluid normally deviates from the moisture content of fibrous material in said zone and the fluid flowing in said zone exchanges moisture with fibrous material whereby the moisture content of fibrous material is changed to a final value; first detector means for measuring the final value of the moisture content of fibrous material which issues from said zone; first adjusting means operatively connected with said first detector means and arranged to adjust said conditioning means so that the moisture content of said fluid respectively decreases and increases when the measured final value of the moisture content of fibrous material respectively exceeds and is less than a predetermined value; second detector means for measuring the moisutre content of fibrous material ahead of said zone; and second adjusting means operatively connected with said second detector means and arranged to adjust said auxiliary moisturizing means when the measured moisture content of fibrous material upstream of said zone deviates from a fixed or variable predetermined moisture content.

2. Apparatus as defined in claim 1, wherein said conveyor means comprises a rotary drum which defines said conditioning zone, said means for conveying said fluid comprising first conduit means having outlet means for discharging said fluid into said inlet end and fluid evacuating second conduit means having an intake end at said outlet end.

3. Apparatus as defined in claim 1, wherein said second path is an endless path in which the gaseous fluid is normally at least substantially sealed from the surrounding atmosphere.

4. Apparatus as defined in claim 1, wherein said conditioning means comprises a vessel defining said second portion of said second path, source of supply of liquid moisturizing agent, adjustable heating means for said moisturizing agent, and means for spraying heated moisturizing agent into the gaseous fluid in said vessel, said first adjusting means being arranged to adjust said heating means.

5. Apparatus as defined in claim 4, wherein said source of supply of moisturizing agent constitutes a portion of said vessel and said adjustable heating means is located outside of said vessel.

6. Apparatus as defined in claim 1, further comprising adjustable heating means provided in said second path downstream of said second portion and upstream of said conditioning zone, third detector means for measuring the temperature of said fluid in said second path upstream of said conditioning zone, and third adjusting means for adjusting said heating means when the measured temperature of said fluid deviates from a predetermined temperature.

7. Apparatus as defined in claim 1, further comprising means for equalizing said tobacco stream in said first path ahead of said conditioning zone.

8. Apparatus as defined in claim 1, further comprising switchover means connected with said second detector means and arranged to furnish signals when the moisture content of fibrous material ahead of said conditioning zone exceeds a predetermined value, and control means operatively connected with said switchover means and arranged to adjust said conditioning means so as to reduce the moisture content of said gaseous fluid in response to said signals.

9. Apparatus as defined in claim 8, further comprising adjustable heating means for said gaseous fluid and regulator means operatively connected with said switchover means and with at least one of said detector means and arranged to adjust said heating means in response to said signals and in response to changes in moisture content which is measured by said one detector means.

10. Apparatus as defined in claim 1, further comprising third and fourth detector means respectively arranged to monitor said first path upstream and downstream of said conditioning zone and to respectively produce first and second signals in response to detected presence of fibrous material, and program means connected with said first adjusting means and said third and fourth detector means and arranged to effect a reduction of the moisture content of said gaseous fluid in the absence of said first and second signals and to simultaneously disconnect said first detector means from said first adjusting means.

11. Apparatus as defined in claim 10, wherein said program means comprises means for setting said adjusting means for an average moisture content of said first gaseous fluid in response to said first signals and for connecting said first detector means with said first adjusting means in response to said second signals.

12. Apparatus as defined in claim 10, wherein said fourth detector means constitutes said first detector means.

13. Apparatus for changing the moisture content of tobacco or analogous fibrous material, comprising conveyor means arranged to advance a stream of fibrous material along a first path including a conditioning zone having an inlet end and an outlet end; adjustable auxiliary moisturizing means operable to admit moisture to fibrous material at the inlet end of said zone; means for conveying a current of hot and normally humid gaseous fluid along a second path a first portion of which coincides substantially with the entire conditioning zone and wherein said fluid flows concurrent with fibrous material; adjustable conditioning means for changing the moisture content of said fluid in a second portion of said second path so that the moisture content of said fluid normally deviates from the moisture content of fibrous material in said zone and the fluid flowing in said zone exchanges moisture with fibrous material whereby the moisture content of fibrous material is changed to a final value; first detector means for measuring the final value of the moisture content of fibrous material which issues from said zone; first adjusting means operatively connected with said first detector means and arranged to adjust said conditioning means so that the moisture content of said fluid respectively decreases and increases when the measured final value of the moisture content of fibrous material respectively exceeds and is less than a predetermined value; second detector means for measuring the quantity of fibrous material in said stream ahead of said zone; and second adjusting means operatively connected with said second detector means and arranged to adjust said auxiliary moisturizing means when the measured quantity of fibrous material ahead of said zone deviates from a predetermined quantity.

14. Apparatus as defined in claim 13, wherein said conveyor means comprises a rotary drum which defines said conditioning zone, said means for conveying said fluid comprising first conduit means having outlet means for discharging said fluid into said inlet end and fluid evacuating second conduit means having an intake end at said outlet end.

15. Apparatus as defined in claim 13, wherein said second path is an endless path in which the gaseous fluid is normally at least substantially sealed from the surrounding atmosphere.

16. Apparatus as defined in claim 13, wherein said conditioning means comprises a vessel defining said second portion of said second path, a source of supply of liquid moisturizing agent, adjustable heating means for said moisturizing agent, and means for spraying heated moisturizing agent into the gaseous fluid in said vessel, said first adjusting means being arranged to adjust said heating means.

17. Apparatus as defined in claim 16, wherein said source of supply of moisturizing agent constitutes a portion of said vessel and said adjustable heating means is located outside of said vessel.

18. Apparatus as defined in claim 13, further comprising adjustable heating means provided in said second path downstream of said second portion and upstream of said conditioning zone, third detector means for measuring the temperature of said fluid in said second path upstream of said conditioning zone, and third adjusting means for adjusting said heating means when the measured temperature of said fluid deviates from a predetermined temperature.

19. Apparatus as defined in claim 13, further comprising third and fourth detector means respectively arranged to monitor said first path upstream and downstream of said conditioning zone and to respectively produce first and second signals in response to detected presence of fibrous material, and program means connected with said first adjusting means and said third and fourth detector means and arranged to effect a reduction of the moisture content of said gaseous fluid in the absence of said first and second signals and to simultaneously disconnect said first detector means from said first adjusting means.

20. Apparatus as defined in claim 19, wherein said program means comprises means for setting said first adjusting means for an average moisture content of said gaseous fluid in response to said first signals and for connecting said first detector means with said first adjusting means in response to said second signals.

21. Apparatus as defined in claim 19, wherein said fourth detector means constitutes said first detector means.

22. A method of changing the moisture content of tobacco or analogous fibrous material, comprising the steps of conveying a stream of fibrous material along a first path including a conditioning zone having an inlet end and an outlet end; admitting moisture to fibrous material at the inlet end of said zone; conveying a current of hot and normally humid gaseous fluid along a second path a first portion of which coincides substantially with the entire conditioning zone and wherein said fluid flows concurrent with fibrous material; changing the moisture content of said fluid in a second portion of said second path so that the moisture content of said fluid normally deviates from the moisture content of fibrous material in said zone and the fluid flowing in said zone exchanges moisture with fibrous material whereby the moisture content of fibrous material is changed to a final value; measuring the final value of the moisture content of the fibrous material which issues from said zone; automatically adjusting said changing step so that the moisture content of said fluid respectively decreases and increases when the measured final value of the moisture content of fibrous material respectively exceeds and is less than a predetermined value; measuring the moisture content of fibrous material ahead of said zone; and automatically adjusting said moisture admitting step when the measured moisture content of fibrous material upstream of said zone deviates from a fixed or variable predetermined moisture content.

23. A method as defined in claim 22, further comprising the step of maintaining the temperature of said gaseous fluid at a constant value.

24. A method as defined in claim 22, wherein said second path is an endless path.

25. A method as defined in claim 22, further comprising the steps of admitting fibrous material into said path in the form of an unequalized stream with varying quantities of fibrous material in successive increments thereof, and equalizing said stream upstream of said conditioning zone.

26. A method as defined in claim 22, wherein said first adjusting step comprises comparing the measured final value of the moisture content of fibrous material with said predetermined value.

27. A method as defined in claim 26, wherein said first adjusting step further comprises conveying said current of gaseous fluid across a spray of an atomized liquid moistening agent and changing the temperature of said spray as a function of deviations of said measured final value of the moisture content of fibrous material from said predetermined value.

28. A method as defined in claim 22, wherein said changing step comprises increasing the moisture content of said fluid and further comprising the step of heating said fluid prior to entry into said conditioning zone, said first adjusting step comprising terminating said changing step when the measured moisture content of fibrous material ahead of said zone exceeds said predetermined moisture content so that said gaseous fluid then merely heats and thus reduces the moisture content of fibrous material in said zone.

29. A method as defined in claim 28, wherein said predetermined moisture content is the same as said predetermined value.

30. A method as defined in claim 28, further comprising the step of varying the temperature of said gaseous fluid prior to entry into said conditioning zone so that the temperature of said gaseous fluid increases when the measured moisture content of fibrous material ahead of said zone exceeds said predetermined moisture content.

31. A method as defined in claim 28, wherein the quantity of fibrous material in said stream fluctuates and further comprising the step of automatically varying the temperature of said gaseous fluid prior to entry into said conditioning zone so that the temperature of said fluid respectively rises and drops when the quantity of fibrous material in said stream increases and decreases while the moisture content of fibrous material ahead of said conditioning zone exceeds said predetermined moisture content.

32. A method of changing the moisture content of tobacco or analogous fibrous material, comprising the steps of conveying a stream of fibrous material along a first path including a conditioning zone having an inlet end and an outlet end; admitting moisture to fibrous material at the inlet end of said zone; conveying a current of hot and normally humid gaseous fluid along a second path a first portion of which coincides substantially with the entire conditioning zone and wherein said fluid flows concurrent with fibrous material; changing the moisture content of said fluid in a second portion of said second path so that the moisture content of said fluid normally deviates from the moisture content of fibrous material in said zone and the fluid flowing in said zone exchanges moisture with fibrous material whereby the moisture content of fibrous material is changed to a final value; measuring the final value of the moisture content of fibrous material which issues from said zone; automatically adjusting said changing step so that the moisture content of said fluid respectively decreases and increases when the measured final value of the moisture content of fibrous material respectively exceeds and is less than a predetermined value; measuring the quantity of fibrous material in said stream ahead of said zone; and automatically adjusting said moisture admitting step when the measured quantity of fibrous material ahead of said zone deviates from a predetermined quantity.

33. A method as defined in claim 32, further comprising the step of maintaining the temperature of said gaseous fluid at a constant value.

34. A method as defined in claim 32, wherein said second path is an endless path.

35. A method as defined in claim 32, wherein said first adjusting step comprises conveying said current of gaseous fluid across a spray of atomized liquid moistening agent and changing the temperature of said spray as a function of deviations of said measured final value of the moisture content of fibrous material from said predetermined value.

* * * * *